US006010085A

United States Patent [19]

Angeletakis

[11] Patent Number: 6,010,085

[45] Date of Patent: Jan. 4, 2000

[54] AGITATOR MILL AND METHOD OF USE FOR LOW CONTAMINATION GRINDING

[75] Inventor: Christos Angeletakis, Orange, Calif.

[73] Assignee: Kerr Corporation, Orange, Calif.

[21] Appl. No.: 09/271,639

[22] Filed: Mar. 17, 1999

[51] Int. Cl.[7] ..... B02C 17/00; B02C 17/22

[52] U.S. Cl. ..... 241/21; 241/24.1; 241/27; 241/182

[58] Field of Search ..... 241/171, 172, 241/182, 27, 29, 21, 24.1

[56] References Cited

U.S. PATENT DOCUMENTS

| | | | |
|---|---|---|---|
| 1,521,169 | 12/1924 | Barker | 241/182 |
| 3,844,490 | 10/1974 | Schold et al. | 241/74 |
| 3,934,828 | 1/1976 | Persson | 241/102 |
| 4,059,232 | 11/1977 | Engels . | |
| 4,117,981 | 10/1978 | Engels . | |
| 4,129,261 | 12/1978 | Engels et al. . | |
| 4,303,205 | 12/1981 | Geiger et al. . | |
| 4,394,981 | 7/1983 | Schold | 241/46.17 |
| 4,496,106 | 1/1985 | Gross . | |
| 4,558,825 | 12/1985 | John et al. . | |
| 5,062,577 | 11/1991 | Schmitt et al. . | |
| 5,065,946 | 11/1991 | Nishida et al. . | |
| 5,133,508 | 7/1992 | Stehr et al. . | |
| 5,335,867 | 8/1994 | Stehr et al. . | |
| 5,556,038 | 9/1996 | Nakamura et al. . | |
| 5,593,097 | 1/1997 | Corbin | 241/21 |
| 5,610,712 | 3/1997 | Schmitz et al. . | |
| 5,785,262 | 7/1998 | Tippett | 241/74 |

OTHER PUBLICATIONS

Draiswerke, Inc., *Technical Data for PERL MILL PML–H/V*, (date unavailable).

*Primary Examiner*—John M. Husar
*Attorney, Agent, or Firm*—Wood, Herron & Evans, L.L.P.

[57] ABSTRACT

The present invention provides a mill having an agitator and grinding chamber which is coated with a non-pigmented, abrasion resistant polymer and a method of using this mill to provide substantially pure ground particles. The polymer coating is typically a thermosetting polymer such as polyurethane or an elastomer such as a fluoroelastomer. The polymer coating provides an abrasion resistant layer between the milling media and the agitator as well as between the grinding chamber and the milling media to prevent spalling, thus increasing the purity of the resultant ground material. The agitator mill may optionally include a ceramic gap separator which is typically formed of stacked plates separated a predetermined distance by shims to separate the ground particles from the milling media in the grinder chamber, thus allowing only the ground particles to pass out of the grinding chamber.

5 Claims, 4 Drawing Sheets

AGITATOR MILL AND METHOD OF USE FOR LOW CONTAMINATION GRINDING

FIELD OF THE INVENTION

The present invention is generally related to an improved agitator mill, and more particularly to an agitator mill and method of use for grinding submicron-sized reinforcing particulate having high purity suitable in a dental composite. Uniformly dispersed in the dental composite, the high purity submicron-sized reinforcing particulate provides high strength, improved wear resistance and gloss retention in clinical use.

BACKGROUND OF THE INVENTION

In density, practitioners use a variety of restorative material in order to create crowns, veneers, direct fillings, inlays, onlays and splint. Composite resins are a type of restorative material which are suspensions of strengthening agents, such as mineral filler particles, in a resin matrix. These materials may be dispersion reinforced, particulate reinforced, hybrid composites or flowable composites. A full discussion of these materials is included in U.S. patent application Ser. No. 09/270,999, entitled "Optimum Particle Sized Hybrid Composite," now pending C. Angeletakis et al. filed on even date herewith (incorporated herein by reference in its entirety).

Highly pure submicron particles are useful in these composite resin materials because they impart the desirable optical properties of high gloss and high translucency. Typically, submicron particles prepared by the commonly employed precipitation or sol gel methods are used to reinforce hybrid composite fillers. However, sol gel preparation methods do not restrict the particle size to at or below the wavelength of visible light and thus do not result in a stable glossy surface in the resin.

While agitator ball mills are known for producing submicron particles, they have previously not been used to produce particles for filler in dental composites because of the impurities which result. The inclusion of impurities in dental composites decreases gloss and translucency. Prior art mills are set forth in U.S. Pat. Nos. 5,335,867; 4,129,261; and 4,117,981, all assigned to Draiswerke GmbH and each incorporated herein by reference in its entirety; and U.S. Pat. No. 5,065,946, assigned to Matsushida Electric Industrial Co. and incorporated herein by reference in its entirety. These prior art mills typically include ceramic or metallic agitators and grinding chambers. During milling, the ceramic or metallic material of the agitator and grinding chamber spalls and becomes co-mingled with the material being ground. In the case of fillers for dental restoratives, these inclusions are unacceptable due to their impact on the optical properties of the restorative. The inclusions may cause decreased gloss due to light scattering and decreased translucency. Draiswerke, Inc., Mahwah, N.J., has applied a polyurethane coating on the agitator and grinding chamber for their PML-H/V machine. The pigment from this coating, however, also contaminates the composites, making them unacceptable for dental use.

The predominant types of milling methods are dry milling and wet milling. In dry milling, air or an inert gas is used to keep particles in suspension. However, fine particles tend to agglomerate in response to van der Waals forces which limits the capabilities of dry milling. Wet milling uses a liquid such as water or alcohol to control reagglomeration of fine particles. Therefore, wet milling is typically used for comminution of submicron-sized particles.

A wet mill typically includes spherical media that apply sufficient force to break particles that are suspended in a liquid medium. Milling devices are categorized by the method used to impart motion to the media. The motion imparted to wet ball mills includes tumbling, vibratory, planetary and agitation. While it is possible to form submicron particles with each of these types of mills, the agitation or agitator ball mill is typically most efficient.

The agitator ball mill, also known as an attrition or stirred mill, has several advantages including high energy efficiency, high solids handling, narrow size distribution of the product output, and the ability to produce homogeneous slurries. The major variables in using an agitator ball mill are agitator speed, suspension flow rate, residence time, slurry viscosity, solid size of the in-feed, milling media size and desired product size. As a general rule, agitator mills typically grind particles to a mean particle size approximately 1/1000 of the size of the milling media in the most efficient operation. In order to obtain mean particle sizes on the order of 0.05 $\mu$m to 0.5 $\mu$m, milling media having a size of less than 0.45 mm can be used. Milling media having diameters of about 0.2 mm and about 0.6 mm are available from Tosoh Ceramics, Bound Brook, N.J. Thus, to optimize milling, it is desirable to use a milling media approximately 1000 times the size of the desired particle. This minimizes the time required for milling.

Previously, the use of a milling process to achieve such fine particle sizes was difficult due to contamination of the slurry by the milling media. By using yttria stabilized zirconia (YTZ or Y-TZP, where TZP is tetragonal zirconia polycrystal) the contamination by spalling from the milling media and abrasion from the mill is minimized. Y-TZP has a fine grain, high strength and a high fracture toughness. YTZ is the hardest ceramic, and because of this hardness, YTZ will not structurally degenerate during milling. High strength Y-TZP is formed by sintering at temperatures of about 1550° C. to form tetragonal grains having 1–2 $\mu$m tetragonal grains mixed with 4–8 $\mu$m cubic grains and high strength (1000 MPa), high fracture toughness (8.5 MPa $m^{1/2}$) and excellent wear resistance. The use of Y-TZP provides a suitable milling media for providing relatively pure structural fillers having mean particle sizes less than 0.5 $\mu$m. Alternatively, glass beads may be used, but because these will abrade, the particular glass used should have optical properties that are the same or similar to the filler material being ground.

Despite some reduction in contamination of the ground filler particulate by the use of YTZ milling media, agitator mills still introduce an unacceptably high level of contamination into dental composites containing the ground filler. Thus, what is needed is an agitator mill that is efficient and produces ground filler particulate that has minimal contamination.

SUMMARY OF THE INVENTION

The present invention is directed to an agitator mill and method of use in which the agitator mill has been modified to include a seal between the agitator shaft and housing and an agitator and grinding chamber that are coated with a clear or non-pigmented polymer to provide substantially pure, contaminant-free, ground particles, preferably in the range of 0.05 $\mu$m–0.50 $\mu$m. The seal may be of any material having a substantially equivalent hardness to YTZ, including YTZ (or Y-TZP) itself. The non-pigmented polymer coating may be a thermoplastic polymer, such as polyethylene; a thermosetting polymer such as polyurethane; or an elastomer, such as a fluoroelastomer. The polymer coating provides an abrasion resistant layer between the milling media and the agitator as well as between the grinding chamber and the milling media to prevent spalling, thus increasing the purity of the resultant ground material. The agitator mill may optionally include a ceramic gap separator located at the output thereof, which functions as a particle filter to exclude oversized particles. The separator is formed of stacked plates separated a predetermined distance by shims to separate the ground particles from the milling media in the grinding chamber, thus allowing only the ground particles to pass out of the grinding chamber.

The particles produced using the agitator mill of the present invention may vary greatly in mean particle size; however, it has been discovered that particles having a mean particle size of between about 0.05 $\mu$m and about 0.5 $\mu$m provide the high strength required for load-bearing dental restorations, yet maintain a glossy appearance in clinical use required for cosmetic restorations. Further, the mill produces nonspherical particles which provide increased adhesion of the resin when used as filler in a dental composite, thereby further enhancing the overall strength of the composite. The filler particles ground with the mill of the present invention are highly pure and contaminant free, preferably having an average particle size less than the wavelength of visible light, that is less than about 0.50 $\mu$m. Highly pure, contaminant free, ground particles of various sizes and size distributions for uses other than dental composites may also be formed using the present invention.

The present invention is capable of grinding to an average particle size of between about 0.05 $\mu$m and 0.5 $\mu$m without the inclusion of impurities in the form of material from the agitator or the grinding chamber. The grinding results in nonspherical particles which, due to their irregular shape, interact with the polymerized resin to a much greater extent. The adhesion of the resin to the particles, when used as a structural filler for a composite, is increased and the overall strength of the composite is thereby increased.

The present invention, with selected media and optimized parameters, produces the particles of desired size, which are free of contamination and exhibit a narrow particle size distribution. The narrow particle size distribution minimizes the small percentage of particles above 0.5 $\mu$m which, when present, contribute to producing a non-glossy surface in clinical applications.

DETAILED DESCRIPTION OF THE INVENTION

The present invention, in a preferred form, is an agitator mill, such as type PML-H/V available from Draiswerke Inc., modified to have a non-pigmented or clear polymer clad agitator and grinding chamber, and further modified by adding a seal of a YTZ hardness equivalent material. The polymer cladding is typically both abrasion and chemically resistant. Suitable cladding polymers include thermoplastic polymers, such as polyethylene and polyamides; thermosetting polymers, such as urethanes; and elastomers, such as a fluoroelastomer. The polymer coating should be applied to a thickness of at least 0.005 inch by any known suitable method. The mill of the present invention may optionally include a gap separator at the output thereof to separate the slurry containing the ground particles from the milling media and to thus retain the milling media within the grinding chamber.

Figure 1:
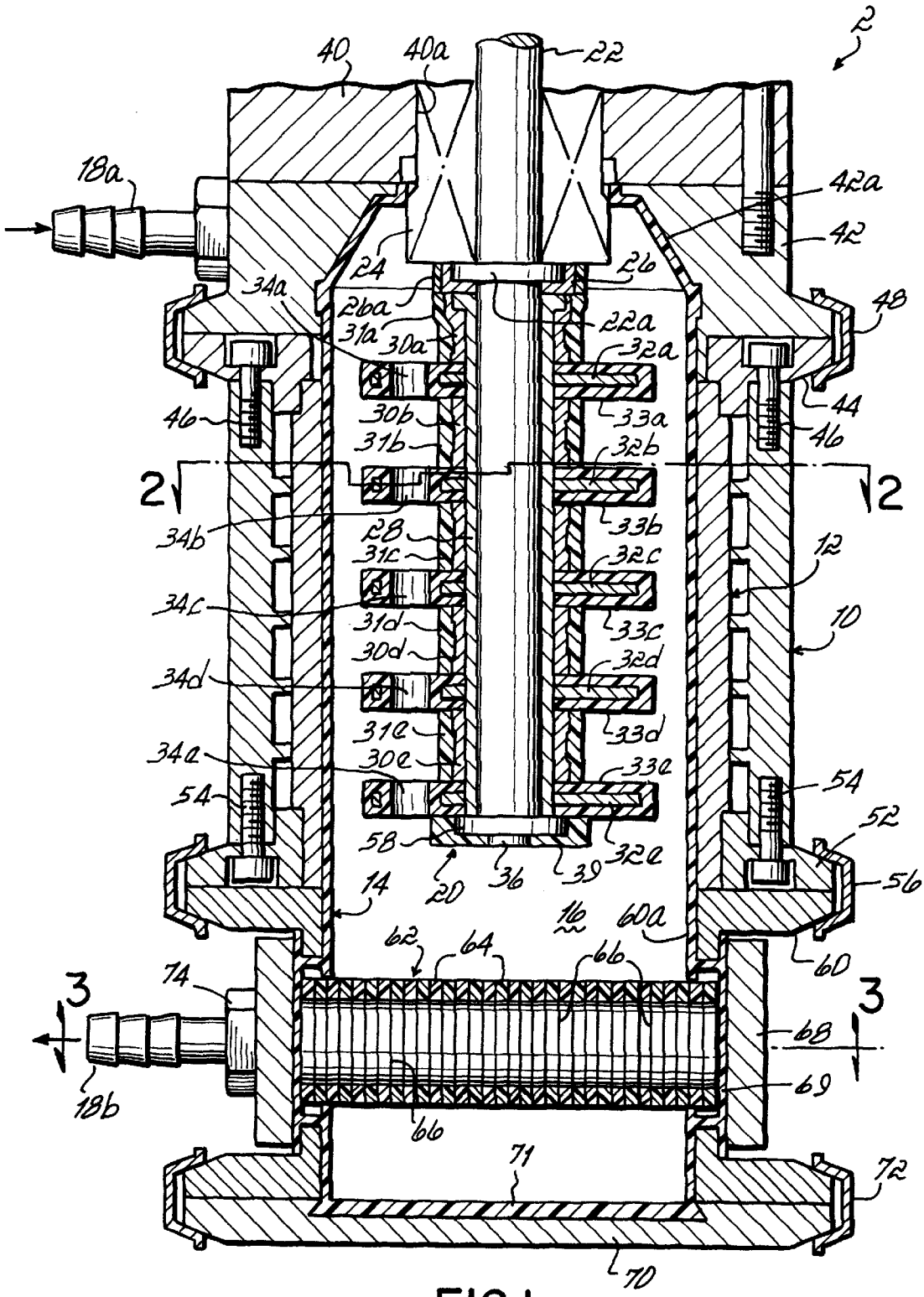
FIG. 1 is a plan view of the agitator mill of the present invention.

As seen in FIG. 1, the agitator mill 2 of the present invention includes a generally cylindrically shaped outer housing 10 supporting an inner housing 12, also generally cylindrically shaped, which carries polymer lining 14 to prevent abrasion of inner housing 12. The inner housing 12 with the polymer lining 14 generally define the grinding chamber 16. The grinding chamber 16 is charged with milling media (not shown), preferably of a type described hereinafter. Grinding chamber 16 is supplied with material to be ground by slurry inlet 18*a*, and slurry is removed from the grinding chamber by slurry outlet 18*b*. Within the grinding chamber 16, a drive shaft 22 rotates the agitator 20 thereby imparting motion to the grinding media to grind the charge. The shaft 22 extends through a cylindrical opening 40*a* of upper housing 40. A motor (not shown) connects to the upper end of the drive shaft 22 to rotate the shaft 22 at the desired rotational rate.

Figure 2:
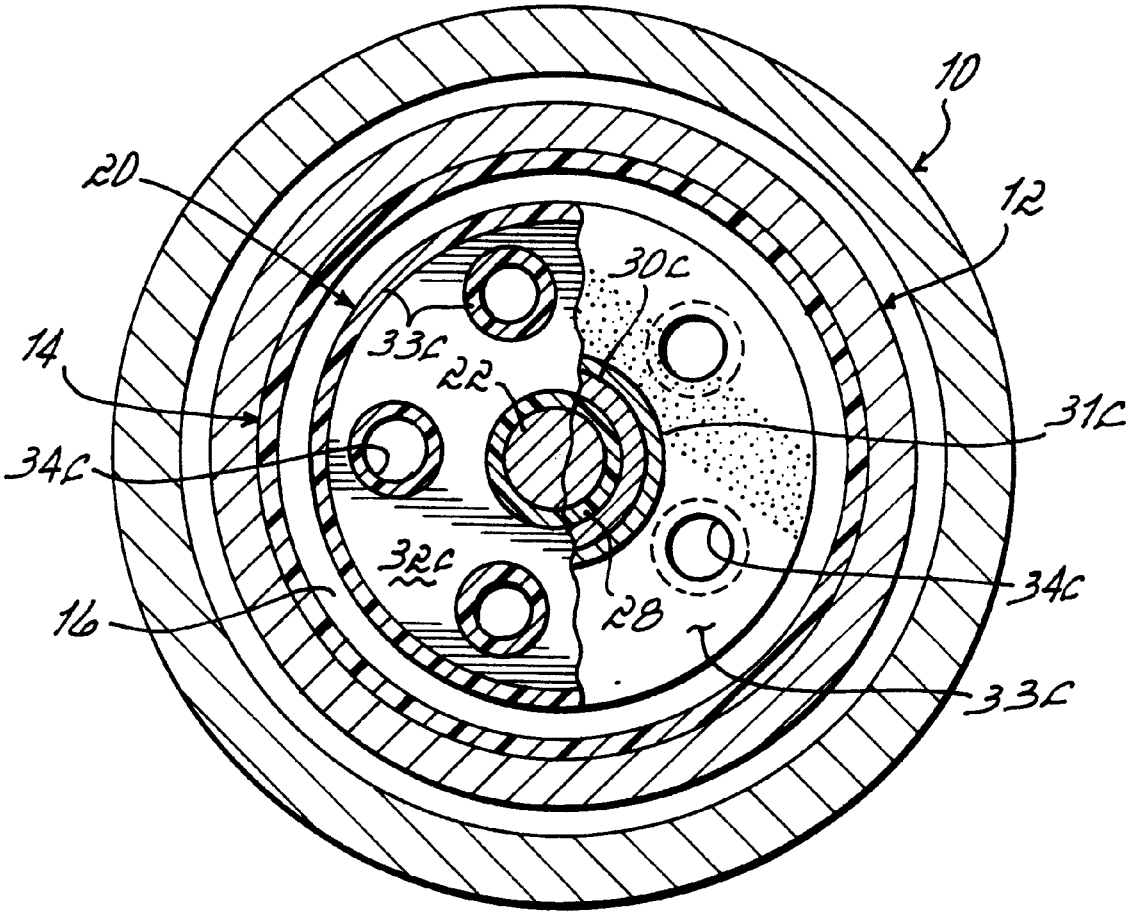
FIG. 2 is a top plan view depicting the agitator within the grinding chamber of the agitator mill of the present invention taken along line 2—2 of FIG. 1.
Figure 3A:
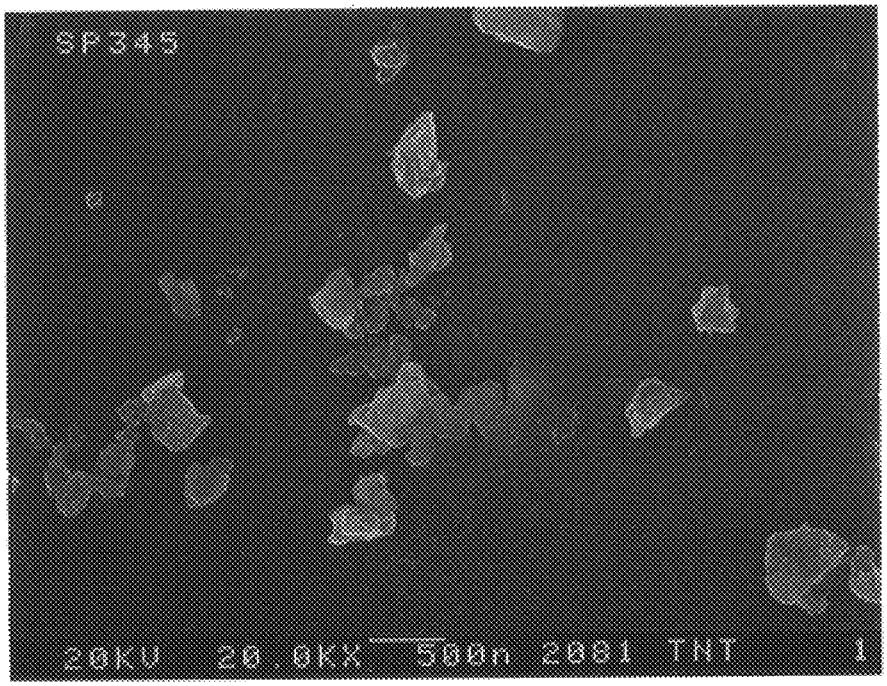
FIG. 3A is a scanning electron micrograph, at 20,000× magnification, of the particulate ground in the improved agitator ball mill of the present invention.
Figure 3B:
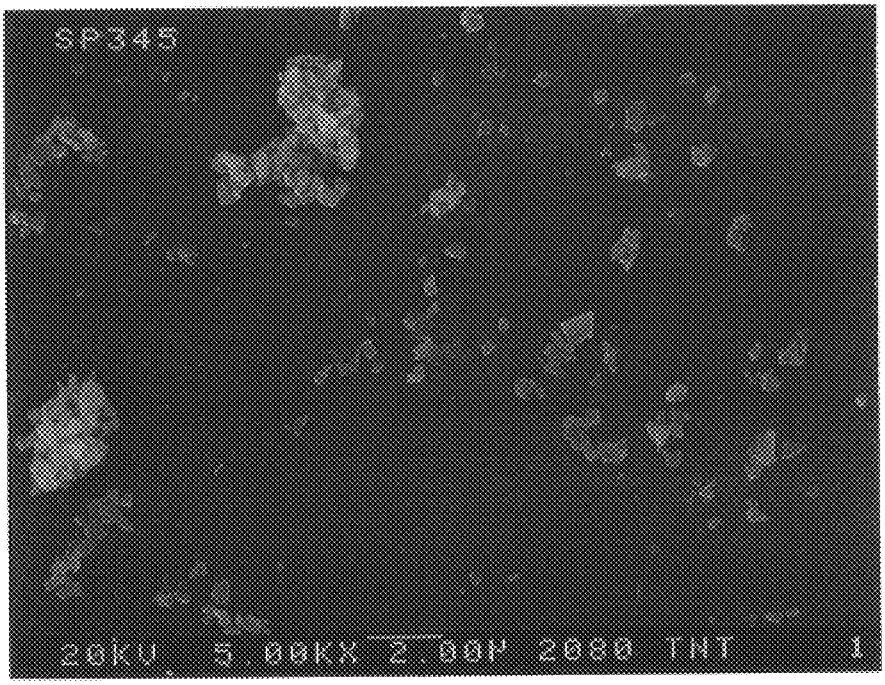
FIG. 3B is a scanning electron micrograph, at 5,000× magnification, of the particulate ground in the improved agitator ball mill of the present invention.
Figure 4A:
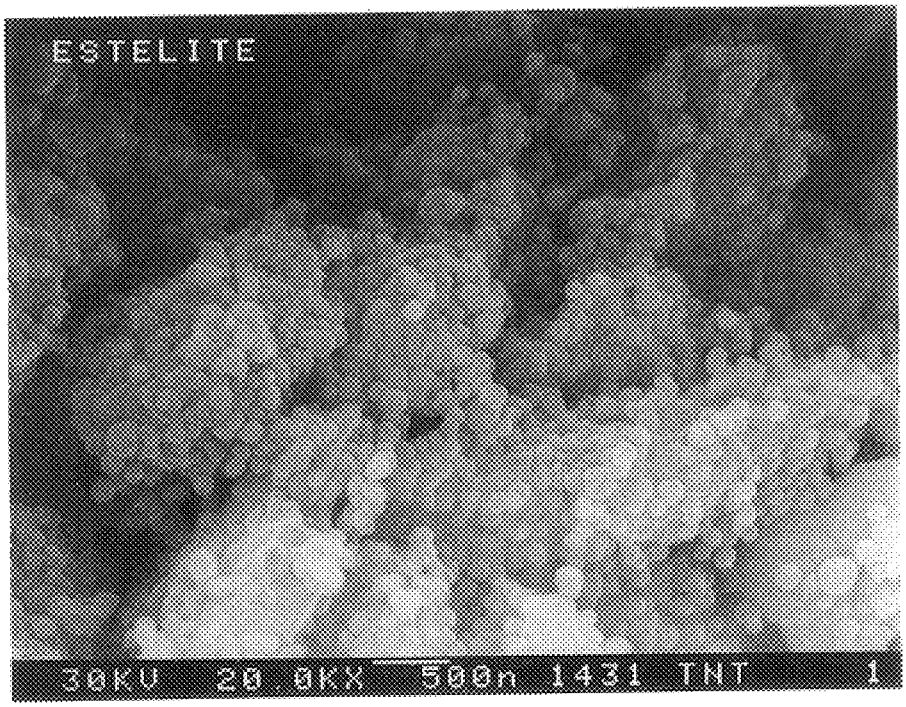
FIG. 4A is a scanning electron micrograph, at 20,000× magnification, of the prior art filler particles formed by sol-gel processes.
Figure 4B:
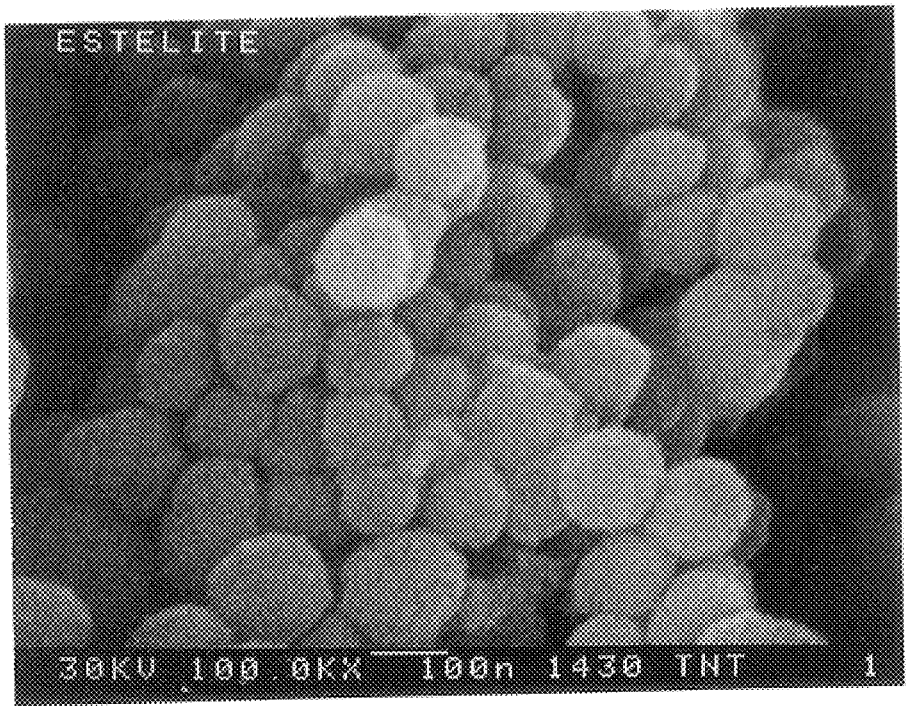
FIG. 4B is a scanning electron micrograph, at 20,000× magnification, of the prior art filler particles formed by sol-gel processes.

In accordance with the principles of the present invention, the drive shaft 22 includes a circumferential flange 22*a* which is in contact with a main seal 24 that seals the opening between the housing and the shaft. To prevent contamination of the charge, main seal 24 must be formed of yttria stabilized zirconia (YTZ), or a material of greater or substantially equivalent hardness, which is a modification of the Draiswerke, Inc. agitator ball mill. YTZ has an approximate Vickers hardness of at least about 11 GPa. Due to the high hardness of the material used for the main seal 24, contamination of the filler material from spalling or abrasion of the seal is reduced or eliminated. Agitator 20 includes spacer 26, which contacts a tubular sleeve 28 and an upper spacer 30*a*. Spacer 26 includes polymer coating 26*a* and plural co-axial spacers 30 include polymer coating 31. In the embodiment shown in FIG. 1, agitator 20 includes five co-axial spacers, 30*a–e*, located at different axial positions along drive shaft 22, and each including a polymer coating 31*a–e*, respectively. Radial extensions in the form of discs 32 (discs 32*a–e*) are supported upon spacers 30 and rotate with shaft 22 to impart motion to the milling media and charge. Discs 32 may be formed of stainless steel or a ceramic material and include polymer layer 33 (33*a–e*, respectively). Discs 32 may optionally include through holes 34 (34*a–e*), which impart additional motion to the milling media and charge. Discs 32 and spacers 30 are alternated along the length of shaft 22 and are secured to the shaft by cap screw 36 and lock nut 38. Lock nut 38 includes polymer coating 39 to prevent contamination of the charge. FIG. 2 shows in a top plan view along line 2—2 of FIG. 1 the polymer clad agitator within the grinding chamber. Referring again to FIG. 1, the grinding chamber 16 is supported by upper housing 40 which is secured to inlet housing 42. Inlet housing 42 includes polymer layer 43 to prevent contamination of the charge. Inlet housing 42 is secured to an upper flange 44 by circumferential clamp 48. Upper flange 44 is secured to outer grinding chamber housing 10 by cap screws 46.

An outlet housing 60 surrounds the portion of the grinding chamber below the agitator 20, where the slurry containing the ground particles is collected for separation from the milling media and removal of the slurry from the ball mill through outlet 18*b*. Outlet housing 60 is secured to the outer grinding chamber housing 10 by lower flange 52, circumferential clamp 56 and cap screws 54. The outlet housing 60 supports a gap separator 62, which is in fluid communication with slurry outlet 18*b*. The gap separator 62 of the present invention consists of a plurality of gap plates 66 separated a predetermined distance by shims 64. The gap separator separates the milling media from the slurry, with the slurry passing out of the ball mill through slurry outlet 18*b*. The shims 64 may be replaceable to redefine the gap between adjacent gap plates 66 if it is desirable to use different sized media. The gap plates 66 are formed of a rugged ceramic material, such as zirconia. The gap separator is not subjected to the intense abrading action that occurs at the seal, the agitator discs and the chamber interior, but some abrasion may still occur. Thus, while the gap separator need not be made of a material as hard as YTZ, it should be a rugged-type ceramic, such as zirconia or a ceramic of equal or greater hardness. Zirconia has a hardness (Mohs scale) of at least about 6.0. Gap separator 62 is secured to outlet housing 60 by plate 68 which includes polymer lining 69 as well as by dome nut 74. Outlet housing 60 is sealed by lower cover 70, which includes polymer liner 71 by circumferential clamp 72.

The polymer material for the coating of the present invention is a non-pigmented polymer. The use of pigment has been found to contaminate the structural filler, and thus, the resulting dental composite. This non-pigmented or clear polymer is applied to the inner surface of the grinding chamber and the exterior surfaces of the agitator at a thickness of at least 0.005 inches.

A wide variety of tough and abrasion-resistant urethane coatings are available for use as the polymer coating on the various components of the agitator mill. Many such polyurethanes are based on the reaction of castor oil, a triol, with an excess of diisocyanate; the resulting triisocyanate undergoes cross-linking by reaction with atmospheric moisture. Urethane alkyds can also be made by reacting an unsaturated drying oil with glycerol, and then reacting the product with a diisocyanate.

Polyurethane (or polyisocyanate) resins are produced by the reaction of a diisocyanate with a compound containing at least two active hydrogen atoms, such as a diol or diamine. Toluene diisocyanate (TDI), diphenylmethane diisocyanate (MDI), and hexamethylene diisocyanate (HDI) are frequently employed.

There are three major types of polyurethane elastomers. One type is based on ether- or ester-type prepolymers that are chain-extended and cross-linked using polyhydroxyl compounds or amines; alternatively, unsaturated groups may be introduced to permit vulcanization with common curing agents such as peroxides. All of these can be processed by methods commonly used for rubber. A second type is obtained by first casting a mixture of prepolymer with chain-extending and cross-linking agents, and then cross-linking further by heating. The third type is prepared by reacting a dihydroxy ester- or ether-type prepolymer, or a diacid, with a diisocyanate such as diphenylmethane diisocyanate and a diol; these thermoplastic elastomers can be processed on conventional plastics equipment. In general, urethane elastomers are characterized by outstanding mechanical properties and resistance to ozone, though they may be degraded by acids, alkalies, and steam. A preferred polyurethane material for the coating of the present invention is a polyester-based polyurethane with a shore A durometer value of 90–95, such as that available commercially from Thistle Roller Co., Montebello, Calif., under the formula number U9500HPLS.

Fluoroelastomers may also be used as the polymer coating in the agitator mill of the present invention. Fluoroelastomers based upon copolymers of vinylidine fluoride and hexafluoropropylene typically include the repeating structure $—CF_2—CH_2—CF_2—CF(CF_3)—$. Such fluoroelastomers are available from DuPont, of Wilmington, Del. under the trade name VITON. The fluoroelastomers can withstand temperatures above 230° C., are resistant to abrasion, lubricants and most solvents.

The agitator mill of the present invention is especially useful in forming particles with a desired mean particle size between about 0.05 $\mu$m and about 0.50 $\mu$m to be used as the structural filler in dental restorations. Structural fillers suitable for use in the present invention include barium magnesium aluminosilicate glass, barium aluminoborosilicate glass, amorphous silica; silica-zirconia; silica-titania; silica titania barium oxide, quartz, alumina and other inorganic oxide particles.

In order to provide ground particles having a mean particle size of less than 0.5 $\mu$m, the mill of this invention extensively comminutes the particles. Comminution provided by the mill of this invention deagglomerates the ground particles by separating particles from clusters, decreases the size of the particles, eliminates large particles by breakage and increases the specific surface area of the particles by producing a large quantity of very fine particles. Size reduction with the agitator mill of this invention occurs due to a combination of: impact with the milling media, abrasion with the milling media and attrition of the particles. The agitator mill of this invention, preferably using a charge of YTZ or Y-TZP media, can produce highly pure particulate of about 0.05 $\mu$m to about 0.5 $\mu$m mean particle size in about 2½ to about 3 hours for a 20% slurry including 700 grams of particulate. The time needed to grind the particulate to the desired size depends on many factors, such as size and amount of particulate, size and amount of milling media, and tip speed.

EXAMPLES

To prepare a structural filler for inclusion into a dental composite, the filler material to be milled, such as barium aluminoborosilicate glass (for example, type SP-345, Specialty Glass, Oldsmar Fla.), is charged into an agitator ball mill of the present invention containing a YTZ milling media.

A one-liter total capacity agitator mill (available from Draiswerke Inc., Mahwah, N.J., type PML-H/V) was modified according to the principles of the present invention to include a clear polyurethane clad agitator and grinding chamber, a YTZ main seal and a YTZ gap separator, as discussed above. The clear polyurethane coating, Formula No. U9500HPLS, was supplied by Thistle Roller Co., Montebello, Calif.

Three methods (A, B and C) were tested in which the agitator mill was filled to 70% of its volume with Y-TZP media. Method A used milling media with a size of 0.65 mm and Method B used milling media with a size of 0.40 mm. A 20% slurry including 700 grams of 345 mesh (20–30 $\mu$m) barium aluminum silicate glass in water (SP-345 available from Specialty Glass, Oldsmar, Fla.) was circulated through the mill and to an outside water-cooled bath at 20–30 liters per hour using a peristaltic pump. The agitator mill was operated at a tip speed of 10 m/sec. for 3 hours. In Method C the slurry of Method A was used, and the mill was then charged with 70% of its volume of 0.20 mm Y-TZP milling media, and the process was repeated for 1.5 hours. During the milling process, rough edges and facets were created on the structural filler particles by the impact with the milling media, abrasion with the milling media and attrition of the particles. Each of these edges provide an adhesion site for the resin which increases the overall strength of the cured composite.

When the 20% filler slurry is removed from the mill, the mean particle size is measured, typically by laser scattering. Laser scattering is a method of measuring mean particle size by sensing the average relative angular intensity of scattered light. A beam of monochromatic light with a uniform wave front is directed at the sample, the light is diffracted or scattered by the particles and a detector is used to measure the relative average intensity of the scattered light at various angles. The mean particle size and size distribution may then be calculated from the relative average intensity. One such laser scattering device is disclosed in U.S. Pat. No. 5,610,712 to Schmitz et al., incorporated herein by reference in its entirety. For the present example, a Horiba Model 2A-910 Laser Scattering Mean Particle Size Analyzer was used. The particle size range of the structural fillers prepared by methods A, B and C are set forth in TABLE 1. TABLE 1 shows, for example, that for Method A, 10% by volume of the filler particles have a mean particle size o less than 0.40 μm; 50% by volume of the filler particles have a mean particle size less than 0.62 μm. and 90% by volume of the fillers particles have a mean particle size less than 0.82 μm.

TABLE 1

| | Mean Particle Sizes In Microns | | |
|---|---|---|---|
| VOLUME | A | B | C |
| 10% | 0.40 μm | 0.27 μm | 0.24 μm |
| 50% | 0.62 μm | 0.47 μm | 0.36 μm |
| 90% | 0.82 μm | 0.76 μm | 0.61 μm |

The dental composite produced using the particles ground by Methods B and C as a structural filler provide restorations having the high strength useful for load bearing restorations, and also provide good translucency and surface gloss, useful in cosmetic restorations. Various properties of dental composites using the structural filler prepared by Methods A, B and C were measured and reported in U.S. patent application Ser. No. 09/270,999, entitled "Optimum Particle Sized Hybrid Composite", now pending C. Angeletakis, et al., filed on even date herewith and incorporated herein by reference in its entirety. The gloss is apparent even after substantial wear as can be observed in a recall appointment 6 months or longer after the placement of the restoration. Through the use of structural filler particles ground using the agitator mill of the present invention and having a mean particle size less than the wavelength of light, a dental composite having high surface gloss and translucency with high strength may be formed.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. For example, polyurethane and fluoropolymers are listed as examples of suitable polymer coatings, however any relatively inert, abrasion resistant, clear coating may be suitable. The invention, in its broader aspects, is therefore not limited to the specific details, representative composition as shown and described. This has been a description of the present invention, along with the preferred coating composition as currently known. However, the invention itself should only be defined by the appended claims.

What is claimed is:

1. A method for efficiently grinding submicron-sized reinforcing detail filler particulate of high purity, comprising the steps of:

providing an agitator mill having a grinding chamber and an agitator extending into and through the grinding chamber, which are coated with a non-pigmented, abrasion resistant polymer coating, the grinding chamber being sealed with a seal at the point where the agitator extends into the grinding chamber, the seal being fabricated of a material having a Vickers hardness of at least about 11 GPa;

charging the grinding chamber with milling media;

charging the grinding chamber with a wet slurry containing the detail filler particulate to be ground;

imparting motion to the agitator for a time sufficient to grind the particulate to a mean particle size of about 0.05 μm to about 0.50 μm; and separating the slurry from the milling media.

2. The method of claim 1, wherein the seal and the milling media are comprised of yttrium stabilized zirconia.

3. The method of claim 1, wherein the polymer coating is a polyurethane coating.

4. The method of claim 1, wherein the seat comprises yttrium stabilized zirconia.

5. The method of claim 1, wherein the milling media is yttrium stabilized zirconia with a diameter of about 0.2 mm to about 0.6 mm.

* * * * *

UNITED STATES PATENT AND TRADEMARK OFFICE

CERTIFICATE OF CORRECTION

PATENT NO. : 6,010,085

DATED : January 4, 2000

INVENTOR(S) : Christos Angeletakis

It is certified that error appears in the above-identified patent and that said Letters Patent is hereby corrected as shown below:

Column 1, line 8 reads "purity suitable in" and should read --purity suitable for use in--.

Column 1, line 15-16 reads "restorative material in" and should read -- restorative materials in --.

Column 1, line 17 reads " and splint" and should read --and splints --.

Column 5, line 67 reads "acids. alkalies. and steam." and should read -- acids, alkalies, and steam --.

Column 7, line 28 reads " particle size o less" and should read --particle size of less --.

Claim 1, line 2 reads "reinforcing detail filler" and should read --reinforcing dental filler --.

Claim 1, line 38 reads "the detail filler" and should read--the dental filler --.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*